US008342628B2

(12) United States Patent
Ito et al.

(10) Patent No.: US 8,342,628 B2
(45) Date of Patent: Jan. 1, 2013

(54) IMAGE FORMING APPARATUS

(75) Inventors: Yoichi Ito, Tokyo (JP); Akiyoshi Tanaka, Fujisawa (JP); Tsuguyori Kemma, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 680 days.

(21) Appl. No.: 12/553,195

(22) Filed: Sep. 3, 2009

(65) Prior Publication Data

US 2010/0061745 A1 Mar. 11, 2010

(30) Foreign Application Priority Data

Sep. 8, 2008 (JP) ..... 2008-230029

(51) Int. Cl.
*B41J 29/38* (2006.01)
*G03G 15/02* (2006.01)

(52) U.S. Cl. ..... 347/14; 347/5; 347/9; 347/10; 347/11; 347/16; 347/37; 347/101; 347/104; 399/43; 399/68

(58) Field of Classification Search ..... 347/5, 9–11, 347/14, 16, 37, 101, 104; 399/43, 68
See application file for complete search history.

(56) References Cited

U.S. PATENT DOCUMENTS

| | | | | |
|---|---|---|---|---|
| 6,453,644 | B1 * | 9/2002 | Baker | 53/403 |
| 6,652,061 | B2 * | 11/2003 | Allen et al. | 347/19 |
| 7,374,267 | B2 * | 5/2008 | Oshio et al. | 347/14 |
| 7,434,927 | B2 | 10/2008 | Sakuma et al. | |
| 2002/0084648 | A1 * | 7/2002 | Pierce et al. | 283/72 |
| 2004/0189784 | A1 * | 9/2004 | Mogi | 347/218 |
| 2005/0185009 | A1 * | 8/2005 | Claramunt et al. | 347/16 |
| 2005/0190224 | A1 * | 9/2005 | Yokoyama | 347/17 |
| 2005/0270323 | A1 * | 12/2005 | Oshio et al. | 347/14 |
| 2006/0023051 | A1 * | 2/2006 | Akiyama et al. | 347/104 |
| 2006/0164491 | A1 | 7/2006 | Sakuma et al. | |
| 2007/0109385 | A1 | 5/2007 | Imoto et al. | |
| 2008/0018689 | A1 * | 1/2008 | Ito et al. | 347/14 |
| 2008/0074453 | A1 * | 3/2008 | Furukawa | 347/14 |
| 2009/0058911 | A1 | 3/2009 | Kogure et al. | |
| 2009/0174749 | A1 | 7/2009 | Kemma | |

FOREIGN PATENT DOCUMENTS

| | | |
|---|---|---|
| JP | 3-59631 | 3/1991 |
| JP | 2007-216648 | 8/2007 |
| JP | 2007-217176 | 8/2007 |
| JP | 2007-254094 | 10/2007 |

OTHER PUBLICATIONS

U.S. Appl. No. 12/508,722 of Akiyoshi Tanaka et al., filed Jul. 24, 2009.

* cited by examiner

*Primary Examiner* — Ryan Lepisto
*Assistant Examiner* — Guy Anderson
(74) *Attorney, Agent, or Firm* — Cooper & Dunham LLP

(57) ABSTRACT

An image forming apparatus including a carriage including image forming units, the carriage driven reciprocally in a main scanning direction; a conveyance unit to convey a sheet of recording media to a position where the image forming units perform image formation; a first detector provided to the carriage, the first detector including a light emitting part and a light receiving part to periodically detect a surface of the sheet; a calculation unit to calculate a relative amount of movement between the sheet and the image forming units by comparing patterns periodically detected by the first detector; and a control unit to control a timing to perform image formation by the image forming units and an amount of conveyance of the sheet conveyed by the conveyance unit based on a result calculated by the calculation unit.

14 Claims, 9 Drawing Sheets

IMAGE FORMING APPARATUS

BACKGROUND

1. Technical Field

This disclosure relates to an image forming apparatus, and more particularly to an image forming apparatus for reading surface properties of a sheet of recording media to adjust and control image formation.

2. Description of the Background

One example of related-art image forming apparatuses having two or more of printing, copying, plotting, and facsimile functions is an inkjet recording device employing a liquid discharge recording method. The inkjet recording device includes a recording head to discharge droplets of a recording liquid such as ink to form an image on a recording medium such as a sheet while the sheet is conveyed.

Examples of the inkjet recording device include a serial-type image forming apparatus, in which the recording head discharges liquid droplets while moving in a main scanning direction to form an image on the sheet, and a line-type image forming apparatus including a line-type recording head to discharge liquid droplets that does so without moving to form an image on the sheet.

In recent years, higher image quality and higher image accuracy are demanded for the image forming apparatuses. For example, a maximum resolution of from 4,800 to 9,600 (horizontal) x from 1,200 to 2,400 (vertical) dpi is set in widely-used inkjet recording devices, and an image is formed with dot intervals of from about 10 to 20 μm in a direction of sheet feed.

In order to achieve such higher image quality and higher image accuracy, higher accuracy in conveyance of a recording medium (or a sheet) when an image is formed thereon is required. Because an eccentricity of several μm is inevitably generated in a conveyance roller to convey the sheet due to cost and manufacturing reasons, an error of several μm in conveyance of the sheet occurs. In a serial-type inkjet recording device, vibration of the device due to reciprocal movement of the carriage that supports the recording head causes vibration of an encoder that detects an amount of rotation of the conveyance roller, an amount of movement of the carriage, and so forth, in a main scanning direction. Consequently, in a case in which timing of discharge of liquid droplets is controlled based on a result detected by a main scanning encoder, image deterioration occurs in the main scanning direction.

To solve the above-described problems, Published Unexamined Japanese Patent Application No. 2007-217176 (hereinafter referred to as JP-2007-217176-A) discloses a controller and a liquid ejection device in which surface characteristics of a sheet are photographed as a consecutive image while the sheet is conveyed by conveyance means. Multiple still images having different timings are extracted from the consecutive image thus photographed and compared with one another to calculate an amount of conveyance of the sheet, so that operation of the conveyance means is controlled based on the amount of conveyance of the sheet thus calculated.

In another approach, JP-2007-216648-A discloses a correction method and a compensation apparatus in which surface characteristics of a sheet are consecutively photographed while the sheet is conveyed by conveyance means. Multiple still images having different timings are extracted from the image thus photographed and compared with one another to calculate an actual amount of conveyance of the sheet. An operational amount of the conveyance means is measured to calculate an estimated amount of conveyance of the sheet based on the operational amount of the conveyance means thus measured. Thereafter, a corrective value of the operational amount of the conveyance means is calculated based on a difference between the estimated amount of conveyance of the sheet and the actual amount of conveyance of the sheet, and the operational amount of the conveyance means is corrected based on the corrective value thus calculated.

In yet another approach, JP-2007-254094-A discloses a paper carrying device in which an optical sensor including an LED or the like provided at a predetermined position along a conveyance path of a sheet periodically reads light and dark patterns in a certain area on a surface of the sheet while the sheet is conveyed. The same portion in the multiple light and dark patterns thus periodically read is compared to calculate an amount of positional change of the sheet.

However, in the above-described methods and devices, the amount of conveyance of the sheet is corrected based on readings from an optical sensor fixed to the devices. Specifically, relative positions of a carriage (or a recording head) and the sheet are indirectly measured via the optical sensor fixed to the devices. Consequently, when a relative amount of movement between the optical sensor fixed to the devices and either the carriage or the sheet varies due to vibration of the devices caused by reciprocal movement of the carriage, an error in the amount of conveyance of the sheet arises that cannot be corrected.

The serial-type inkjet recording device generally includes a main scanning encoder including an encoder scale provided along a main scanning direction and an encoder sensor provided to a carriage. A timing of liquid droplet discharge is determined based on a signal from the main scanning encoder, and the recording head is driven to discharge the liquid droplets at that timing.

In the serial-type inkjet recording device, vibration of the carriage due to reciprocal movement of the carriage itself and vibration of the serial-type inkjet recording device due to reciprocal movement of the carriage causes vibration of the main scanning encoder that detects the amount of movement of the carriage. Consequently, the timing of discharge of the liquid droplets as determined by readings from the main scanning encoder varies, causing image deterioration in the main scanning direction.

SUMMARY

In one aspect of this disclosure, an image forming apparatus in which image formation is performed while detecting a relative amount of movement between an image forming unit and a sheet is provided to achieve higher image quality.

In an illustrative embodiment, an image forming apparatus includes a carriage including image forming units, the carriage driven reciprocally back and forth in a main scanning direction; a conveyance unit to convey a sheet of recording media to a position where the image forming units perform image formation; a first detector provided to the carriage, the first detector including a light emitting part and a light receiving part to periodically detect a surface of the sheet; a calculation unit to calculate a relative amount of movement between the sheet and the image forming units by comparing patterns periodically detected by the first detector; and a control unit to control a timing to perform image formation by the image forming units and an amount of conveyance of the sheet conveyed by the conveyance unit based on a result calculated by the calculation unit.

Additional aspects, features and advantages of the present invention will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF THE ILLUSTRATIVE EMBODIMENTS

Figure 1:
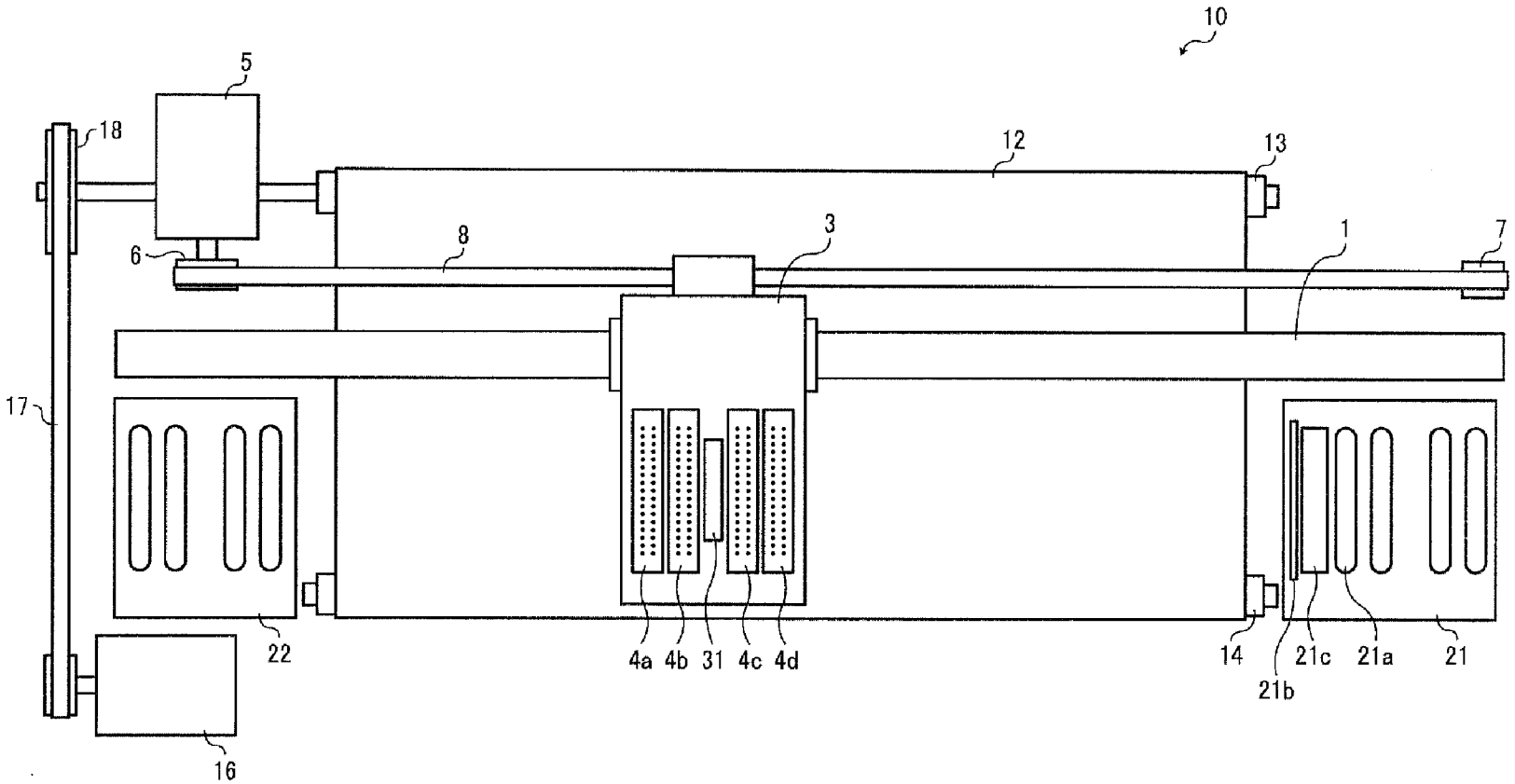
FIG. 1 is a plan view illustrating an inkjet recording device serving as an image forming apparatus according to illustrative embodiments.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Image forming apparatuses employing the liquid discharge recording method hereinafter described form an image on a recording medium, such as paper, string, fiber, cloth, lather, metal, plastics, glass, wood, and ceramics by discharging liquid droplets onto the recording medium. In this specification, an image refers to both signifying images such as characters and figures, as well as non-signifying images such as patterns. Further, in this specification, ink includes any material which is discharged as a liquid, such as a DNA sample, a resist, and a pattern material. Although the image forming apparatuses to be described in detail below include the recording head using the liquid discharge head as image forming means, the image forming means is not limited to such a recording head.

Figure 2:
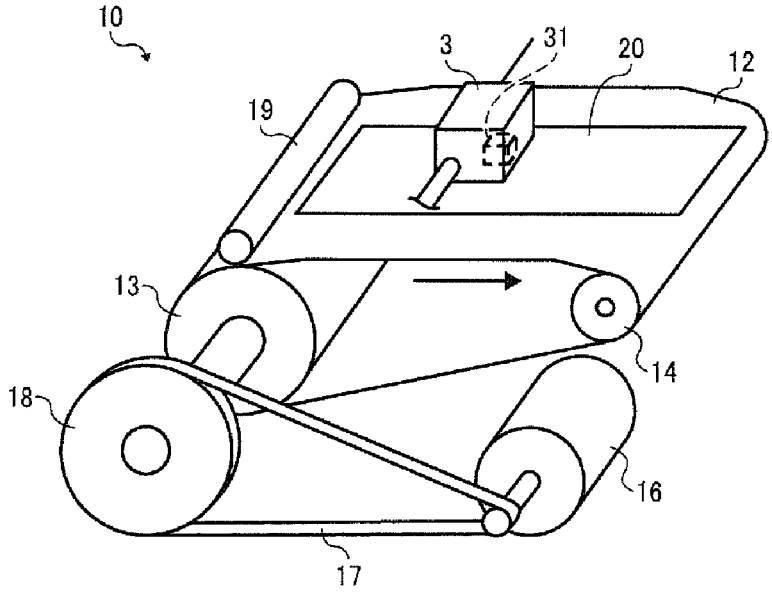
FIG. 2 is a perspective view illustrating the inkjet recording device illustrated in FIG. 1.
Figure 3:
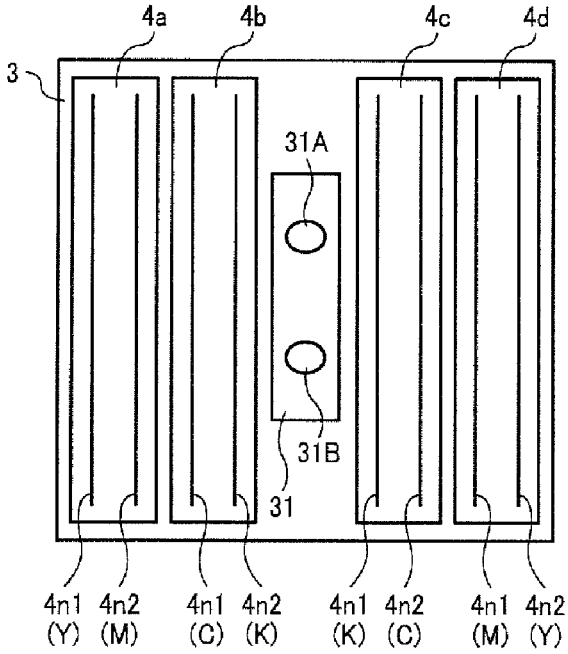
FIG. 3 is a plan view illustrating relative positions of recording heads and a sensor respectively provided to a carriage according to a first illustrative embodiment.

A description is now given of an inkjet recording device 10 serving as an image forming apparatus according to illustrative embodiments, with reference to FIGS. 1 to 3. FIG. 1 is a plan view illustrating the inkjet recording device 10. FIG. 2 is a perspective view illustrating the inkjet recording device 10. FIG. 3 is a plan view illustrating relative positions of recording heads 4 and a sensor 31 respectively provided to a carriage 3 according to a first illustrative embodiment.

The inkjet recording device 10 includes a main guide rod 1 extended across and between right and left lateral side plates, not shown, and a sub-guide member, not shown, and a carriage 3 that is movably supported by the main guide rod 1 and the sub-guide member. The carriage 3 is moved in a main scanning direction by a main scanning motor 5 through a timing belt 8 stretched between a drive pulley 6 and a driven pulley 7.

The carriage 3 includes recording heads 4*a*, 4*b*, 4*c*, and 4*d* (hereinafter collectively referred to as recording heads 4), each serving as image forming means. Each of the recording heads 4 includes a liquid discharge head to discharge ink droplets of either yellow (Y), cyan (C), magenta (M), or black (K). In each of the recording heads 4, nozzle arrays including multiple nozzles are arranged in a sub-scanning direction perpendicular to the main scanning direction. The recording heads 4 are provided such that a direction of discharge of the ink droplets faces downward. It is to be noted that, in FIG. 1, the recording heads 4 viewed through the carriage 3 from the top of the carriage 3 are illustrated.

Specifically, as illustrated in FIG. 3, each of the recording heads 4 includes two parallel nozzle arrays 4*n*1 and 4*n*2 (hereinafter correctively referred to as nozzle arrays 4*n*). The nozzle array 4*n*1 of the recording head 4*a* discharges ink droplets of yellow (Y), and the nozzle array 4*n*2 of the recording head 4*a* discharges ink droplets of magenta (M). The nozzle array 4*n*1 of the recording head 4*b* discharges ink droplets of cyan (C), and the nozzle array 4*n*2 of the recording head 4*b* discharges ink droplets of black (K). The nozzle array 4*n*1 of the recording head 4*c* discharges ink droplets of black (K), and the nozzle array 4*n*2 of the recording head 4*c* discharges ink droplets of cyan (C). The nozzle array 4*n*1 of the recording head 4*d* discharges ink droplets of magenta (M), and the nozzle array 4*n*2 of the recording head 4*d* discharges ink droplets of yellow (Y).

Each of the recording heads 4 serving as the liquid discharge head may include a pressure generator to generate pressure to discharge liquid droplets. Examples of the pressure generator include a piezoelectric actuator having a piezoelectric element, a thermal actuator using an electrothermal converting element such as a heat-generation resistant body to use a phase change caused by film boiling of a liquid, a memory metal actuator using a metal phase change caused by a temperature change, and an electrostatic actuator using an electrostatic force.

The inkjet recording device 10 further includes a conveyance belt 12 serving as conveyance means to electrostatically attract a sheet 20 to convey the sheet 20 to a position opposite the recording heads 4, that is, an image forming position. The conveyance belt 12 in this particular embodiment is a seamless belt stretched between a conveyance roller 13 and a tension roller 14. The conveyance belt 12 is designed to rotate in a direction of conveyance of the sheet 20, that is, a sub-scanning direction, and is charged by a charging roller, not shown, while rotating.

The conveyance belt 12 may be either a single-layered belt or a multi-layered belt. When a single-layered belt is used as the conveyance belt 12, because the conveyance belt 12 contacts the sheet 20 and the charging roller as described above, the layer thereof is formed of an insulating material. By contrast, when a multi-layered belt is used as the conveyance belt 12, a part of the conveyance belt 12 contacting the sheet 20 or the charging roller is formed of an insulating layer, and the other part of the conveyance belt 12 not contacting the sheet 20 or the charging roller is formed of a conductive layer.

The conveyance roller 13 is driven by a sub-scanning motor 16 via a timing belt 17 and a timing pulley 18 so that the conveyance belt 12 is rotated in the sub-scanning direction. A pressing roller 19 is provided opposite the conveyance roller 13. It is to be noted that, for simplification, the pressing roller 19 is indicated by a single roller member in FIG. 2.

The inkjet recording device 10 further includes a maintenance/recovery mechanism 21 to perform maintenance and recovery of the recording heads 4 at one side of the conveyance belt 12 in the main scanning direction of the carriage 3. A droplet receiver 22 to receive ink droplets not used for image formation discharged from the recording heads 4 during an idle state is provided at the other side of the conveyance belt 12 in the main scanning direction of the carriage 3. The maintenance/recovery mechanism 21 includes a cap member 21*a* to cap a surface of each of the recording heads 4 having the nozzle arrays 4*n*1 and 4*n*2 (hereinafter referred to as a nozzle surface), a wiper 21*b* to wipe the nozzle surface of each of the recording heads 4, and a droplet receiver 21*c* to receive ink droplets not used for image formation discharged from the recording heads 4.

The carriage 3 further includes a sensor 31 at a center thereof in the main scanning direction and the sub-scanning direction to periodically read a surface of the sheet 20. According to the first illustrative embodiment, the recording heads 4 each discharging ink droplets of the same color are arranged symmetrically to each other on both sides of the sensor 31 in the main scanning direction.

In the inkjet recording device 10 having the above-described configuration, when the sheet 20 is fed from a paper feeder, not shown, to the conveyance belt 12 charged by the charging roller, the sheet 20 is attracted to the conveyance belt 12 and is conveyed in the sub-scanning direction by rotation of the conveyance belt 12. The recording heads 4 are driven in response to an image signal while the carriage 3 is moved in the main scanning direction so that ink droplets are discharged from the recording heads 4 to the sheet 20 stopped at that position. Accordingly, data for a single line is recorded on the sheet 20. Thereafter, the sheet 20 is moved by a predetermined distance by the conveyance belt 12 and data for the next line is recorded on the sheet 20. The above-described recording operations are finished in response to a recording completion signal or a signal reporting that a trailing edge of the sheet 20 reaches a recording area. The sheet 20 having the data thereon is then discharged to a discharge tray, not shown.

Figure 4:
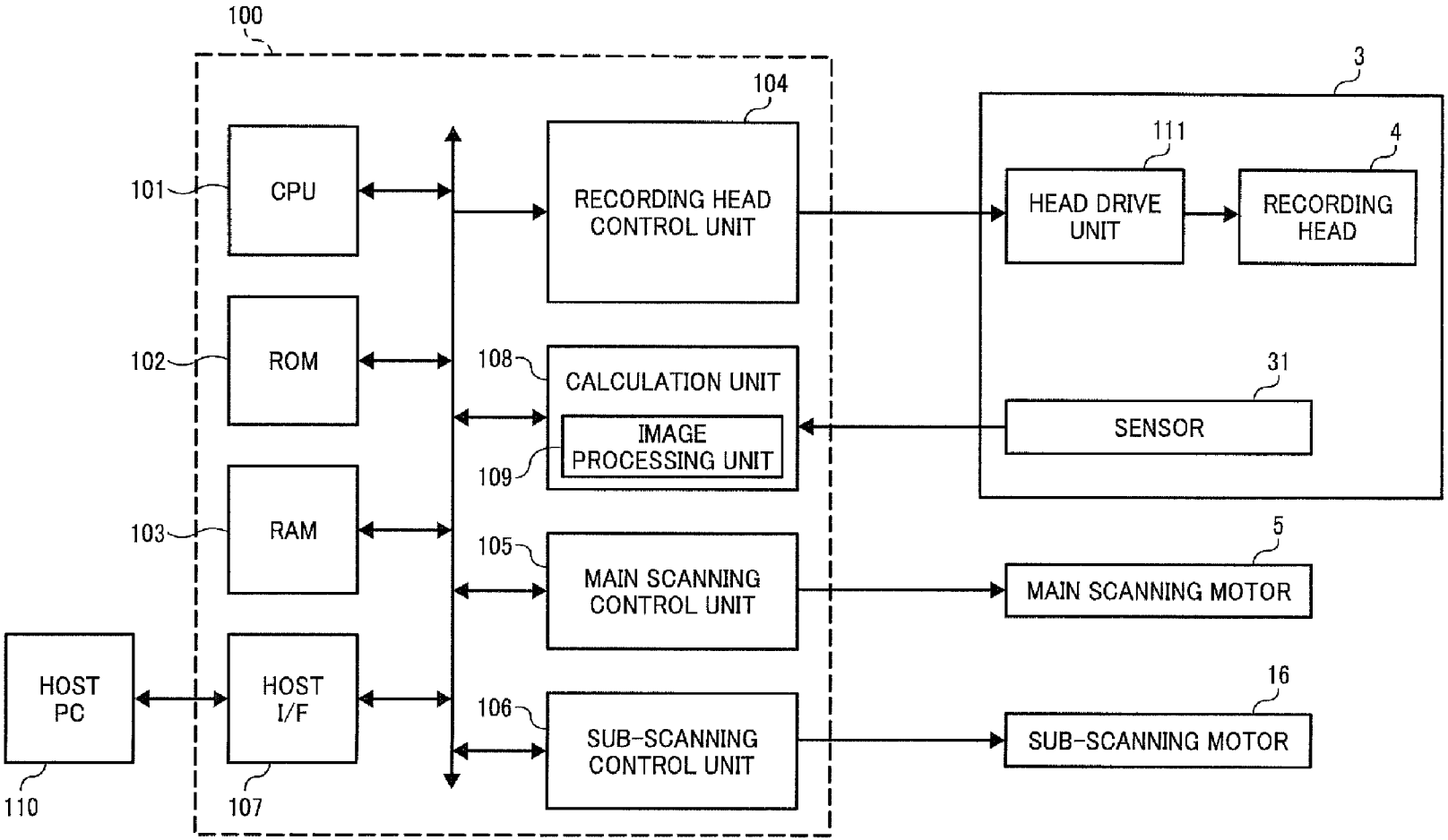
FIG. 4 is a functional block diagram of a control unit included in the inkjet recording device.

A description is now given of a control unit 100 of the inkjet recording device 10, with reference to FIG. 4.

FIG. 4 is a functional block diagram of the control unit 100. The control unit 100 serves as control means and calculation means. Specifically, the control unit 100 includes a CPU 101 to control the inkjet recording device 10, a ROM 102, a RAM 103, a recording head control unit 104, a main scanning control unit 105, a sub-scanning control unit 106, a host I/F 107, an image processing unit 109 to periodically loading read images from a reading signal from the sensor 31 to perform image processing, and a calculation unit 108 to calculate a relative amount of movement between the recording heads 4 and the sheet 20 based on a result of image processing performed by the image processing unit 109.

The ROM 102 stores drive waveform data to generate a common drive signal sent to firmware that controls hardware of the inkjet recording device 10 and a head drive unit 111 that drives the recording heads 4. The RAM 103 is used as a buffer and a work memory to store a variety of data. The recording head control unit 104 includes a drive signal generation circuit that generates the common drive signal for the recording heads 4, and sends the common drive signal to the head drive unit 111 installed in the carriage 3 together with image data and a control signal. The recording head control unit 104 causes the recording heads 4 to discharge ink droplets at a discharge timing obtained based on the relative amount of movement between the recording heads 4 and the sheet 20 calculated by the calculation unit 108.

The main scanning control unit 105 controls driving of the main scanning motor 5 based on the relative amount of movement between the recording heads 4 and the sheet 20 calculated by the calculation unit 108 to control movement and a stop position of the carriage 3. The sub-scanning control unit 106 controls the sub-scanning motor 16 based on the relative amount of movement between the recording heads 4 and the sheet 20 calculated by the calculation unit 108 to rotate the conveyance roller 13, so that movement and a stop position of the conveyance belt 12, that is, conveyance of the sheet 20, are controlled.

The control unit 100 receives a print job, that is, image data, sent from a host PC 110 such as a data processing device via the host I/F 107, and stores the image data thus received in bitmap format. It is to be noted that, in the above-described case, the image data is rendered as bitmap data by a printer driver included in the host PC 110, and then the bitmap data is forwarded to the control unit 100 of the inkjet recording device 10. However, in a case in which image data is rendered as bitmap data by the inkjet recording device 10, image data sent and stored in a reception buffer included in the host I/F 107 is read out and analyzed and the analyzed result, that is, intermediate code data, is stored in a predetermined area in the RAM 103. Thereafter, dot pattern data for outputting an image is generated using font data stored in the ROM 102 based on the analyzed result thus stored, and the dot pattern data thus generated is stored in another predetermined area in the RAM 103.

The main scanning control unit 105 moves the carriage 3 including the recording heads 4 to a predetermined position on the sheet 20 based on the relative amount of movement between the recording heads 4 and the sheet 20 calculated by the calculation unit 108. The recording head control unit 104 operates in conjunction with the relative amount of movement calculated by the calculation unit 108, and forwards the image data stored in the RAM 103, the common drive signal generated from head drive data stored in the ROM 102, and the control signal such as a gradation control signal to the head drive unit 111. The head drive unit 111 drives the actuators in the recording heads 4 based on the data forwarded from the recording head control unit 104 to cause the recording heads 4 to discharge ink droplets.

When main scanning operations of the carriage 3 for a single line are completed, the sub-scanning control unit 106 causes the conveyance belt 12 to move based on the relative amount of movement calculated by the calculation unit 108 so that the sheet 20 is moved a predetermined distance. The above-described operations are repeated to form an image on the sheet 20.

Figure 5:
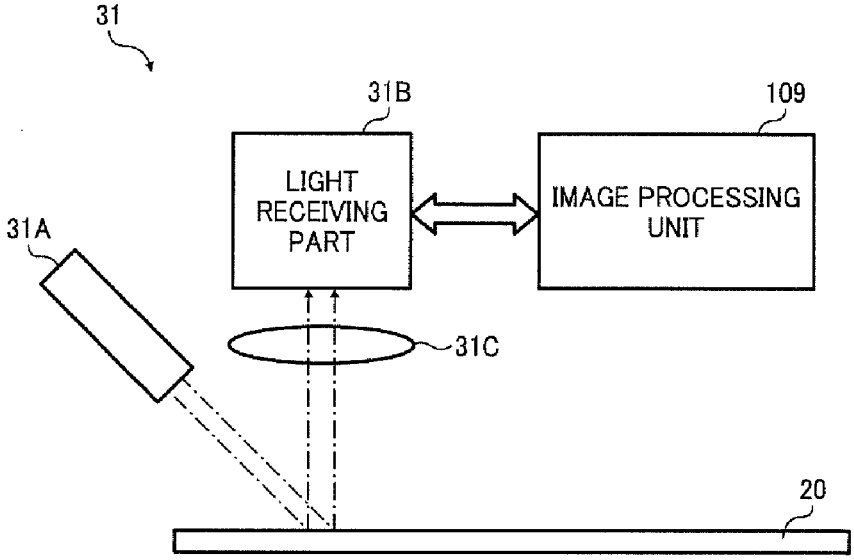
FIG. 5 is a schematic view illustrating the sensor.
Figure 6:
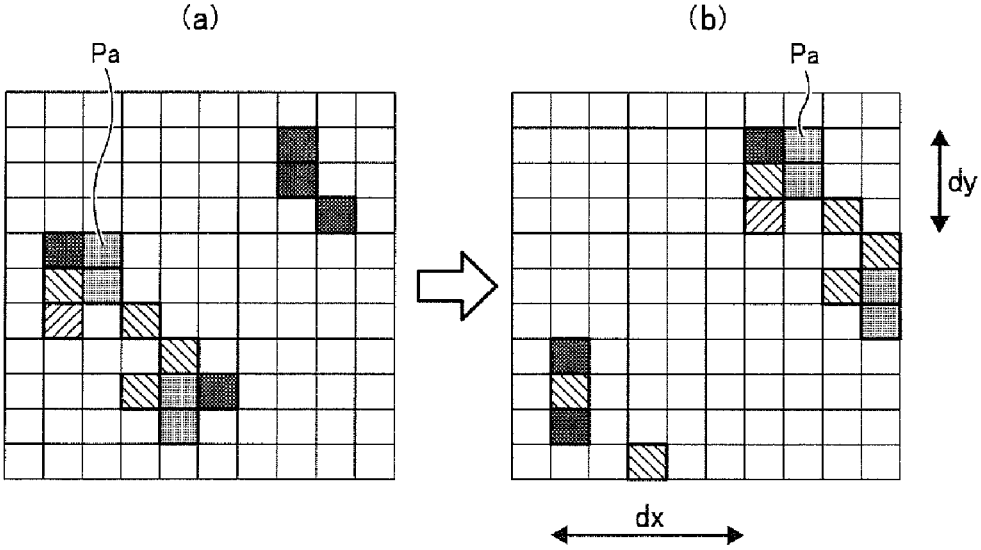
FIG. 6 is a view illustrating light and dark patterns used for calculation of a relative amount of movement between the recording heads and a sheet.

A description is now given of calculation of the relative amount of movement between the recording heads 4 and the sheet 20, with reference to FIGS. 5 and 6. FIG. 5 is a schematic view illustrating the sensor 31. FIG. 6 is a view illustrating light and dark patterns used for calculation of the relative amount of movement between the recording heads 4 and the sheet 20.

The sensor 31 includes a light emitting part 31A and a light receiving part 31B. The light emitting part 31A emits light to the surface of the sheet 20, and the light reflected from the surface of the sheet 20 is received by the light receiving part 31B via a lens 31C. Because there are fibers and unevenness on the surface of the sheet 20, that is, physical properties of the sheet 20, light and dark patterns illustrated in FIG. 6 are detected by periodically reading the surface of the sheet 20 using the sensor 31. The image processing unit 109 processes the light and dark patterns thus detected by the sensor 31 to calculate two dimensional amounts of movement dx and dy of the sheet 20 in x and y directions, respectively.

For example, an amount of movement of the sheet 20 can be obtained by comparing the same part in multiple light and dark patterns thus detected. Specifically, by comparing the light and dark pattern illustrated in FIG. 6(*a*) and that illustrated in FIG. 6(*b*), it is found that a pattern Pa is moved by 5 dots in the x direction and 3 dots in the y direction, with one block representing one dot.

Accordingly, the relative amount of movement between the recording heads 4 and the sheet 20 can be obtained. Further, because light and dark patterns in portions outside the sheet 20 (such as the surface of the conveyance belt 12 or the like) that are periodically read by the sensor 31 also vary, an amount of movement of the recording heads 4 (or the carriage 3) can be obtained in the same manner as described above even when the sensor 31 faces those portions outside the sheet 20.

Figure 7:
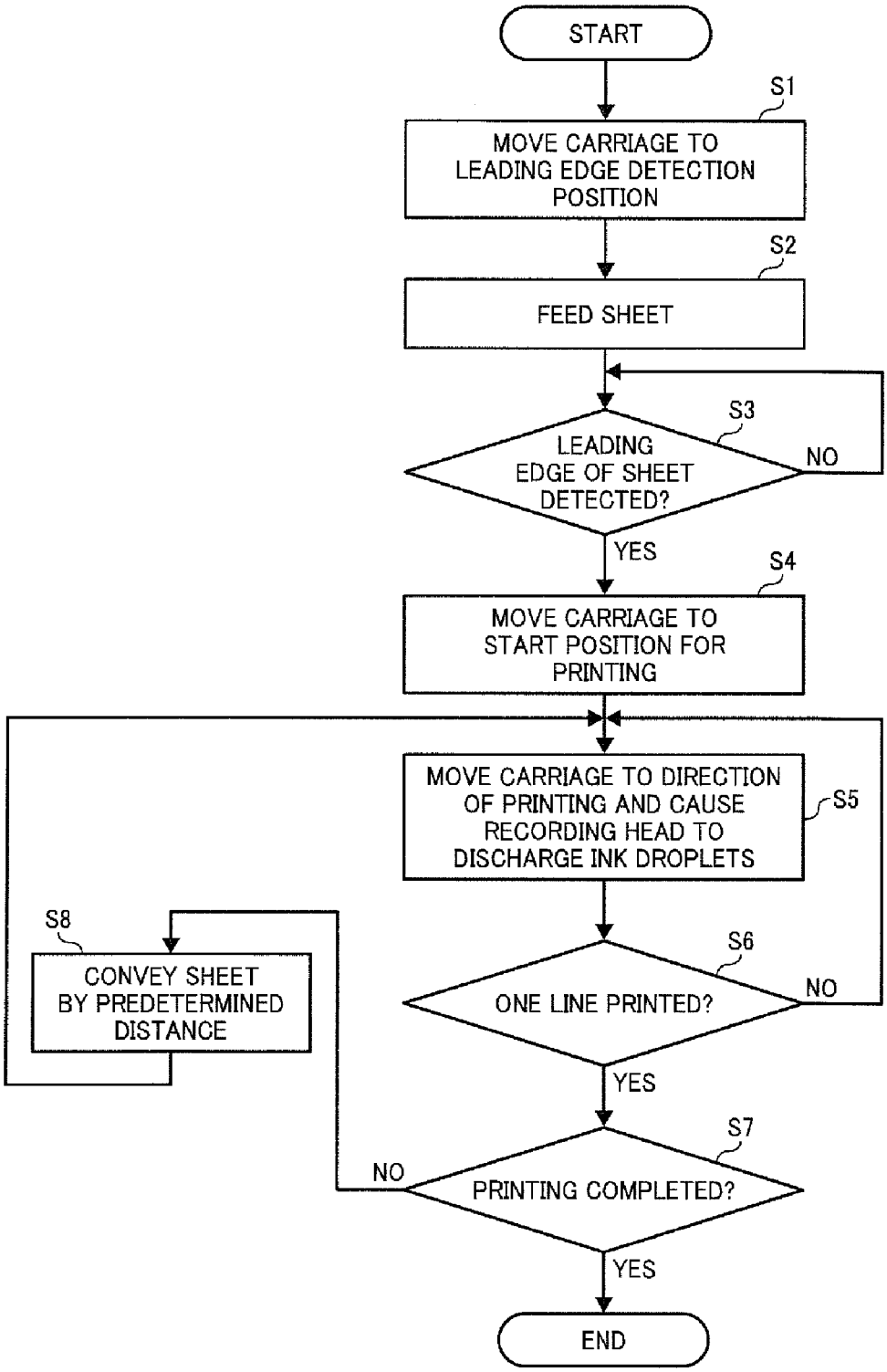
FIG. 7 is a flowchart illustrating an example of printing operations performed by the control unit.

A description is now given of printing operations performed by the control unit 100, with reference to FIG. 7. FIG. 7 is a flowchart illustrating an example of printing operations performed by the control unit 100.

When printing operations are started, at S1, the control unit 100 moves the carriage 3 from a home position to a position to detect a leading edge of the sheet 20 (hereinafter referred to as a leading edge detection position). At S2, the sheet 20 is fed and conveyed by the conveyance belt 12, and the sensor 31 of the carriage 3 is used as a leading edge detection sensor to detect the leading edge of the sheet 20. At S3, the control unit 100 determines whether or not the leading edge of the sheet 20 is detected. Here, the sensor 31 cannot read the sheet 20 when the carriage 3 is moved from the home position to the leading edge detection position. Therefore, the sensor 31 periodically reads surfaces of the conveyance belt 12 or the maintenance/recovery mechanism 21, so that the control unit 100 moves the carriage 3 to the leading edge detection position while performing image processing and calculating the relative amount of movement between the carriage 3 and the conveyance belt 12 or the maintenance/recovery mechanism 21.

As described above, even when not facing the sheet 20, the sensor 31 periodically reads portions other than the sheet 20, that is, the surface of the conveyance belt 12 or the like as described above, so that the control unit 100 controls movement of the carriage 3 while calculating the relative amount of movement between the carriage 3 and the conveyance belt 12. As a result, the control unit 100 can control movement of the carriage 3 even when ink droplets not used for image formation are discharged to the droplet receiver 22, maintenance/recovery operations are performed by the maintenance/recovery mechanism 21, and the carriage 3 is moved to the home position as well as when the carriage 3 is moved to the leading edge detection position. Similarly, in a case of duplex printing, movement of the conveyance belt 12 without having the sheet 20 thereon needs to be controlled even when the sheet 20 having a printed image on only one side thereof is conveyed to a duplex printing unit, the sheet 20 is discharged, and charging of the conveyance belt 12 is controlled. In such a case, the sensor 31 periodically reads the surface of the conveyance belt 12 so that the control unit 100 calculates the relative amount of movement to control movement of the conveyance belt 12.

Returning to FIG. 7, when the leading edge of the sheet 20 is detected (YES at S3), the process proceeds to S4. At S4, the carriage 3 is moved to a start position for printing. At S5, the control unit 100 causes the recording heads 4 to discharge ink droplets while moving the carriage 3 in a direction of printing to form an image on the sheet 20. At this time, the sensor 31 periodically reads the surface of the sheet 20, and the control unit 100 calculates a relative amount of movement between the recording heads 4 and the sheet 20 and determines a timing to discharge the ink droplets based on the relative amount of movement thus calculated, so that the recording heads 4 discharge the ink droplets at that timing. It is to be noted that although a one-path printing method is described herein for simplification, illustrative embodiments are applicable to other printing methods, such as an interlace method and a multipath method.

Thereafter, at S6, the control unit 100 determines whether or not printing of one line is completed. When printing of one line is completed (YES at S6), the process proceeds to S7 to determine whether or not printing is completed. When printing is not completed (NO at S7), the process proceeds to S8 to convey the sheet 20 by a predetermined distance using the conveyance belt 12. Also at this time, the sensor 31 periodically reads the surface of the sheet 20, and the control unit 100 causes the conveyance belt 12 to convey the sheet 20 by a predetermined distance while calculating the relative amount of movement between the carriage 3 and the sheet 20. As a result, the sheet 20 can be accurately conveyed.

As described above, the inkjet recording device 10 includes the sensor 31 in the carriage 3 to periodically read the surface of the sheet 20, and the calculation unit 108 to compare the light and dark patterns periodically read by the sensor 31 to calculate the relative amount of movement between the sheet 20 and the carriage 3. The inkjet recording device 10 further includes the control unit 100 to control the timing of image formation performed by the carriage 3 and the amount of movement of the sheet 20 performed by the conveyance belt 12 based on the result calculated by the calculation unit 108. As a result, image formation can be performed while the relative amount of movement between the carriage 3 and the sheet 20 is directly detected, providing higher quality images.

Figure 8:
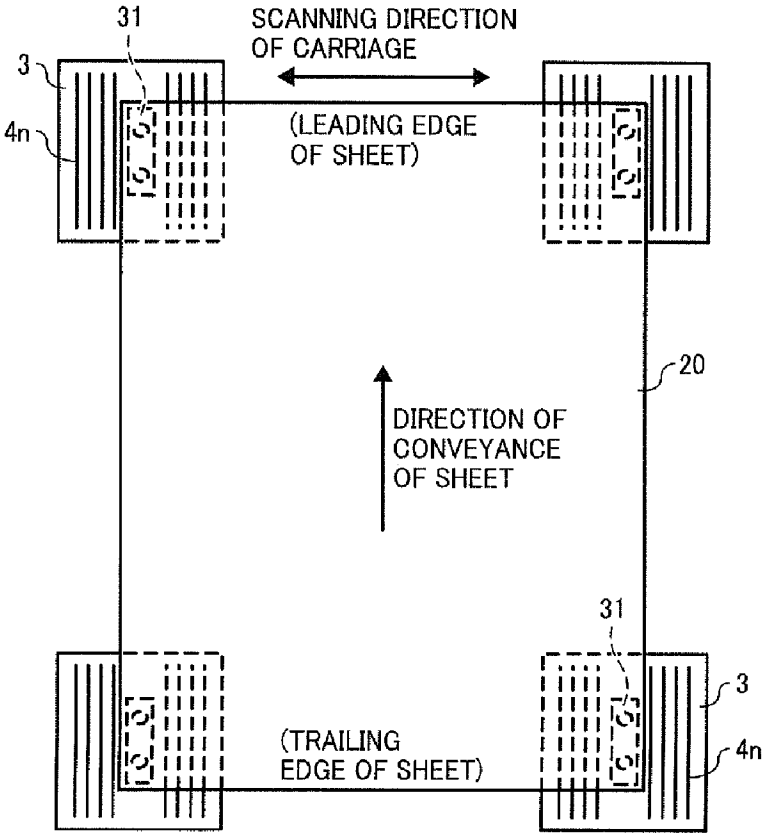
FIG. 8 is a view illustrating a state in which the carriage according to the first illustrative embodiment faces a leading edge of a sheet together with a state in which the carriage faces a trailing edge of the sheet, both viewed from a bottom surface side of the carriage.

A description is now given of a position of the sensor 31 in the carriage 3 according to the first illustrative embodiment and areas in the sheet 20 read by the sensor 31, with reference to FIG. 8. FIG. 8 is a view illustrating a state in which the carriage 3 according to the first illustrative embodiment faces the leading edge of the sheet 20 together with a state in which the carriage 3 faces the trailing edge of the sheet 20, both viewed from a bottom surface side of the carriage 3.

According to the first illustrative embodiment, the sensor 31 is provided at a center of the carriage 3 in the main scanning direction and the sub-scanning direction as illustrated in FIG. 3. The multiple nozzle arrays 4*n* to discharge ink droplets of the same color are arranged symmetrically to each other on both sides of the sensor 31.

Accordingly, when an image is printed on the sheet 20, the sensor 31 faces the sheet 20 at both the leading and trailing edges of the sheet 20 as illustrated in FIG. 8. In other words, the sensor 31 faces almost all the areas of the sheet 20 to directly read the surface of the sheet 20, and the ink droplets of the respective colors are discharged from the nozzle arrays 4*n* of the recording heads 4 to form an image on the sheet 20.

Figure 9:
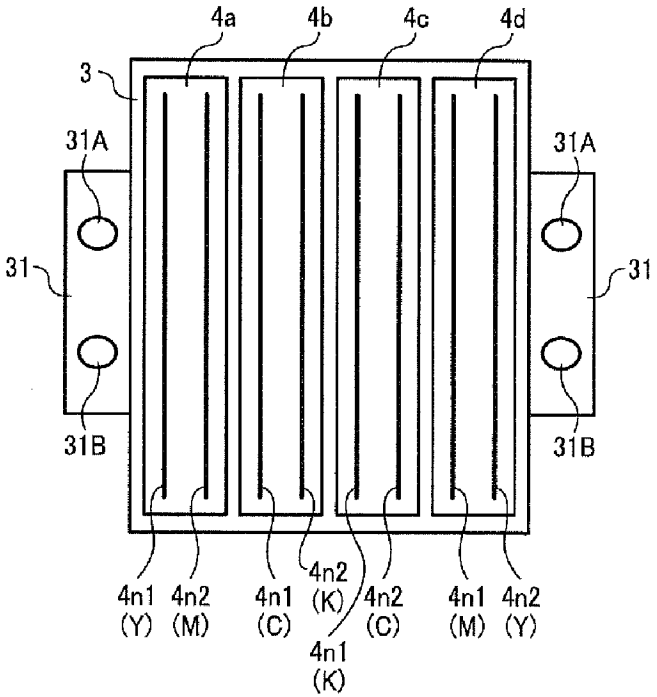
FIG. 9 is a plan view illustrating relative positions of recording heads and two sensors respectively provided to a carriage according to a second illustrative embodiment.

A description is now given of a position of the sensor 31 in the carriage 3 according to a second illustrative embodiment and areas in the sheet 20 read by the sensor 31, with reference to FIG. 9. FIG. 9 is a plan view illustrating relative positions of the recording heads 4 and two sensors 31 respectively provided to the carriage 3 according to the second illustrative embodiment.

According to the second illustrative embodiment, the two sensors 31 are provided to the carriage 3. Specifically, each of the two sensors 31 is provided on a lateral portion of the carriage 3 in the main scanning direction. In FIG. 9, the multiple nozzle arrays 4*n* are arranged such that the nozzle arrays 4*n* that discharge the ink droplets of the same color are symmetrically arranged in the recording heads 4 in the same manner as the first illustrative embodiment. However, it is to be noted that the nozzle arrays 4*n* that discharge the ink droplets of the same color do not need to be arranged symmetrically in the recording heads 4.

In the second illustrative embodiment, when an image is printed on the sheet 20, either one of the sensors 31 faces the sheet 20 at the leading and trailing edges of the sheet 20. Accordingly, the sensors 31 face almost all the areas of the sheet 20 to directly read the surface of the sheet 20, and the ink droplets of the respective colors are discharged from the nozzle arrays 4*n* of the recording heads 4 to form an image on the sheet 20.

Figure 11:
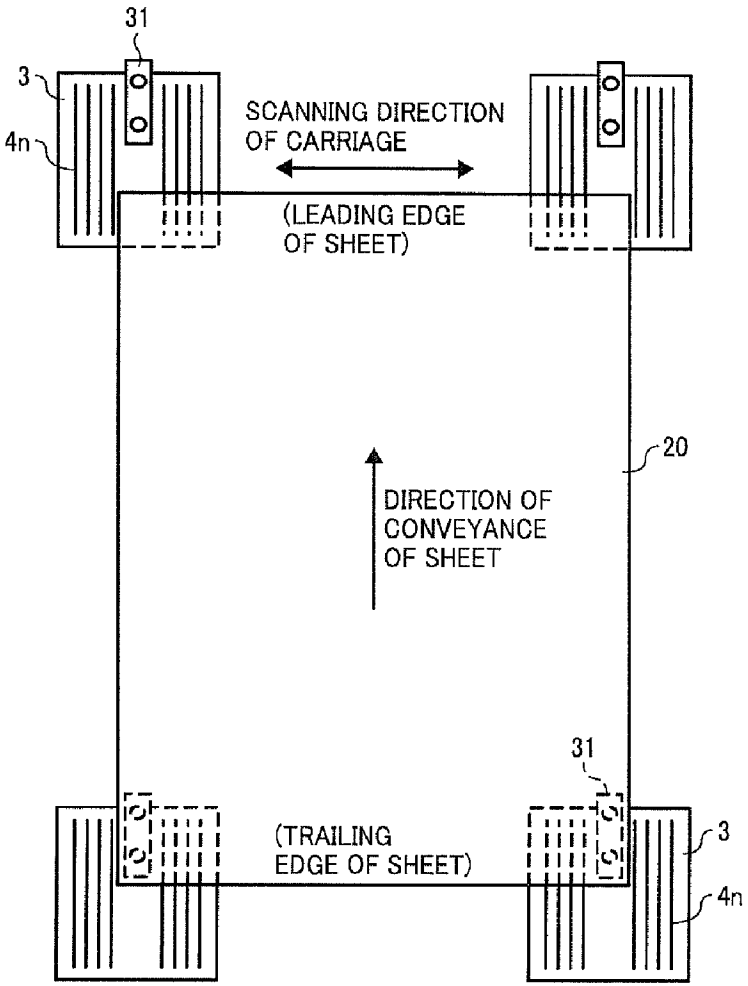
FIG. 11 is a view illustrating a state in which the carriage according to the comparative example faces a leading edge of a sheet together with a state in which the carriage faces a trailing edge of the sheet, both viewed from a bottom surface side of the carriage.
Figure 10:
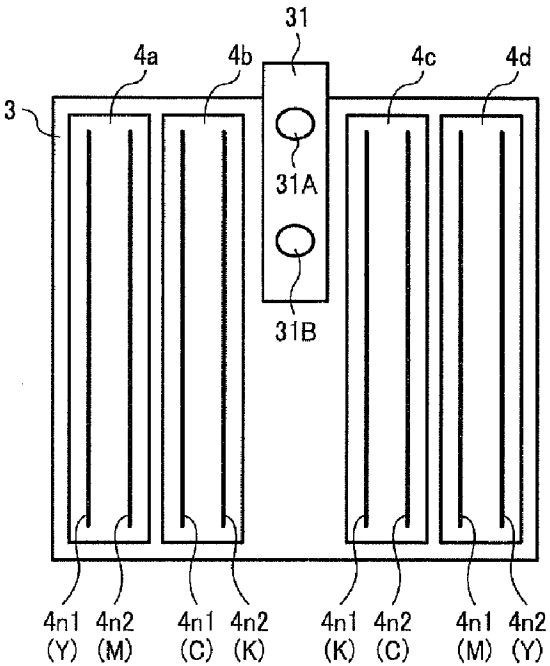
FIG. 10 is a plan view illustrating relative positions of recording heads and a sensor respectively provided to a carriage according to a comparative example.

To further facilitate an understanding of the advantages of the present invention, a description is now given of a position of the sensor 31 in the carriage 3 according to a comparative example and areas in the sheet 20 read by the sensor 31, with reference to FIGS. 10 and 11. FIG. 10 is a plan view illustrating relative positions of the recording heads 4 and the sensor 31 respectively provided to the carriage 3 according to the comparative example. FIG. 11 is a view illustrating a state in which the carriage 3 according to the comparative example faces the leading edge of the sheet 20 together with a state in which the carriage 3 faces the trailing edge of the sheet 20, both viewed from the bottom surface side of the carriage 3.

According to the comparative example, the sensor 31 is positioned at the center of the carriage 3 in the main scanning direction, but is shifted toward the sub-scanning direction.

As illustrated in FIG. 11, although the sensor 31 faces the sheet 20 at the trailing edge of the sheet 20, a larger area at the leading edge of the sheet 20 is not directly read by the sensor 31. Consequently, there is a large blank area where printing cannot be performed at the leading edge of the sheet 20.

Therefore, in the comparative example, in the area where the sensor 31 cannot directly read the surface of the sheet 20, movement of the carriage 3 and the conveyance belt 12 is controlled by periodically reading the surface of the conveyance belt 12 (or a surface of a conveyance roller in a case of not using the conveyance belt 12) using the sensor 31. Specifically, as described above, the light and dark patterns detected by the sensor 31 are compared with one another to calculate the relative amount of movement between the recording heads 4 and the sheet 20 so that the timing to discharge the ink droplets and conveyance of the sheet 20 are controlled.

However, it is preferable to design the sensor 31 to directly read the surface of the sheet 20 at least at a portion where the sheet 20 tends to slip the most, for example, when the trailing edge of the sheet 20 passes between the conveyance roller 13 and the pressing roller 19.

By comparing the first and second illustrative embodiments to the comparative example, it can be seen that the sensor 31 according to either the first or second illustrative embodiment can directly read all the areas on the surface of the sheet 20 to calculate the relative amount of movement between the recording heads 4 and the sheet 20. As a result, the sensor 31 according to either the first or second illustrative embodiment can more accurately control the timing to discharge the ink droplets and movement of the sheet 20 and provide higher image quality compared to the sensor 31 according to the comparative example.

Further, in the carriage 3 according the comparative example, the relative amount of movement between the recording heads 4 and the sheet 20 is obtained by directly reading the surface of the sheet 20 and the relative amount of movement between the recording heads 4 and the conveyance belt 12 is obtained by reading the surface of the conveyance belt 12 using the sensor 31, respectively, to control the timing to discharge the ink droplets and movement of the sheet 20. At this time, an error tends to occur when the sensor 31 is positioned over the edge of the sheet 20 while reading the amount of movement of the sheet 20 depending on a thickness of the sheet 20. However, such an error can be prevented by the carriage 3 according to either the first and second illustrative embodiment.

Figure 12:
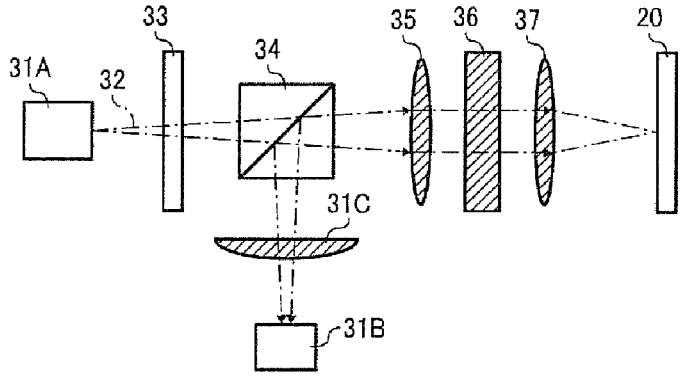
FIG. 12 is a schematic view illustrating a focusing mechanism of the sensor according to illustrative embodiments.

A detailed description is now given of a focusing mechanism of the sensor 31, with reference to FIG. 12. FIG. 12 is a schematic view illustrating the focusing mechanism of the sensor 31 according to illustrative embodiments.

A laser beam 32 emitted from a laser diode included in the light emitting part 31A passes through a diffraction grating 33 to form a side beam. Thereafter, the laser beam 32 passes through a deflection member 34 and further passes through a lens 35 to form parallel light. The laser beam 32 further passes through a $1/\lambda$ wavelength plate 36 and an objective lens 37 to be directed to the sheet 20. The laser beam 32 is turned into the parallel light so that the objective lens 37 is moved in accordance with movement of the sheet 20. The light reflected from the sheet 20 is directed to the light receiving part 31B through the lens 31C by the deflection member 34 to detect focus and to perform reading.

There is a trade-off between productivity and image quality in inkjet recording devices, and consequently inkjet recording devices usually include various printing modes so that a user can select between either higher image quality and higher image accuracy or higher printing speed and productivity.

Accordingly, a focal length and a focal range can be adjusted, and conveyance speed and image quality can be adjusted based on a printing mode. More specifically, the focal length and the focal range are changed to read a wider area of the sheet 20 to increase printing speed. By contrast, when higher image quality is demanded, the sensor 31 focuses on a smaller area of the sheet 20 at slower speed so that the sheet 20 is conveyed with higher accuracy.

Because it includes the focusing mechanism as described above, the sensor 31 can reliably focus on movement of the sheet 20 in a height direction of the sheet 20. Accordingly, the relative amount of movement between the sheet 20 and the recording heads 4 is more accurately detected.

Further, the recording sensor 31 having the focusing mechanism can detect a height (or a thickness) of the sheet 20 at the image forming position so that a distance between the sheet 20 and the carriage 3 in a vertical direction can be reliably adjusted for each of the sheet 20. Accordingly, image deterioration caused by a shift in a position to discharge the ink droplets between successive reciprocal movements of the carriage 3 due to a difference between the vertical distance between the carriage 3 and the sheet 20 can be minimized. Further, the occurrence of paper jams caused by collision between the carriage 3 and the sheet 20 can be reduced. As a result, paper jams can be prevented even when the sheet 20 is set incorrectly, thus improving performance of the inkjet recording device 10.

Figure 13:
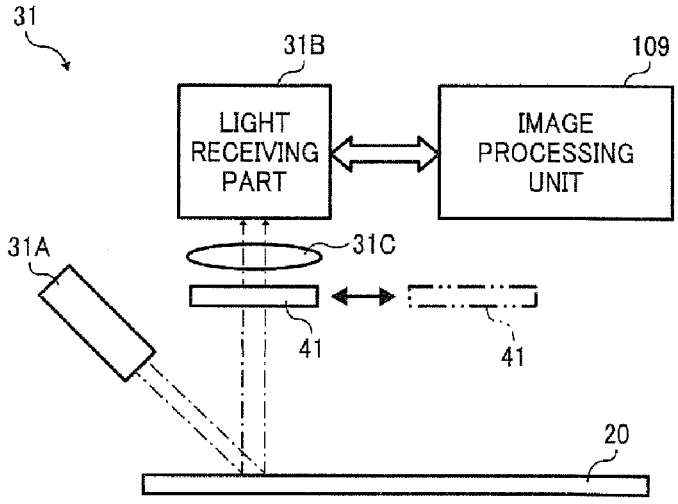
FIG. 13 is a schematic view illustrating a sensor including a shutter that protects the sensor from ink mist.

A description is now given of protection of the recording sensor 31 from ink mist or the like, with reference to FIG. 13. FIG. 13 is a schematic view illustrating the sensor 31 including a shutter 41 that protects the sensor 31 from ink mist.

Referring to FIG. 13, the shutter 41 to open or close a surface of the lens 31C is movably provided to the sensor 31. The shutter 41 closes the surface of the lens 31C at a position indicated by solid lines in FIG. 13, and opens the surface of the lens 31C at a position indicated by broken lines in FIG. 13.

In a case in which the liquid discharge head is used as the image forming means, a large amount of ink mist tends to be generated during maintenance and recovery operations of the liquid discharge head, when liquid droplets not used for image formation are discharged to prevent the ink in the nozzles from drying out and clogging the nozzles. To prevent the above-described problem, at least the light receiving part 31B is shielded by the shutter 41 when such large amounts of ink mist are generated to protect the light receiving part 31B from the ink mist or dust, thus providing higher accuracy in detection.

Figure 14:
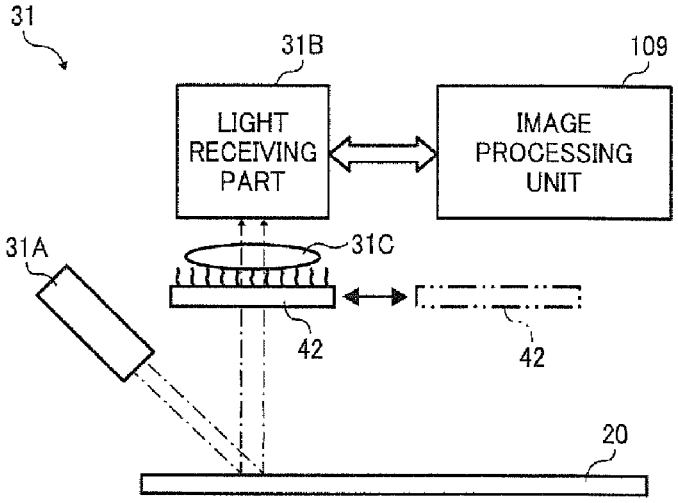
FIG. 14 is a schematic view illustrating a sensor including a cleaning member.

A description is now given of cleaning of the sensor 31 with reference to FIG. 14.

As described above, detection accuracy or reading accuracy of the sensor 31 is degraded by ink mist or dust adhering to the sensor 31. In order to prevent such deterioration of detection accuracy, a cleaning member 42 is provided to clean a surface of the lens 31C of the sensor 31. The cleaning member 42 moves reciprocally between positions indicated by solid lines and broken lines, respectively, in FIG. 14. The surface of the lens 31C is cleaned by the cleaning member 42 when the cleaning member 42 is moved to the position indicated by the solid lines in FIG. 14 at a predetermined time. It is to be noted that the cleaning member 42 may also serve as the shutter 41, or be separately provided from the shutter 41 as an independent member.

Another example of printing operations performed by the control unit 100 is described in detail below with reference to FIG. 15.

In this example, when the carriage 3 is moved and the ink droplets are discharged from the recording heads 4 to perform printing operations, the conveyance belt 12 is driven to move the sheet 20 so that movement of the recording heads 4 is sequentially switched to the sub-scanning direction depending on the amount of conveyance of the sheet 20 to form an image on the sheet 20.

Figure 15:
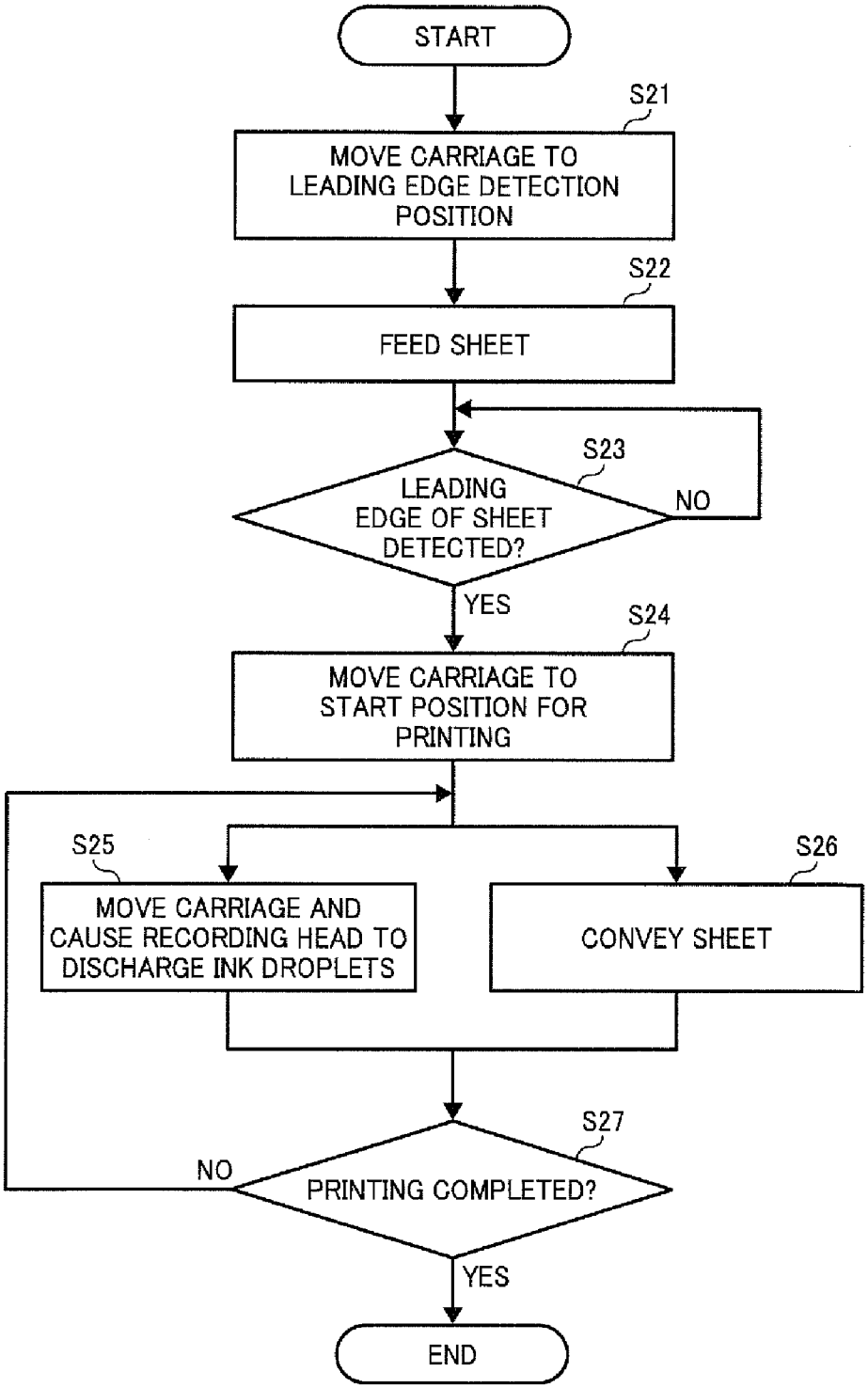
FIG. 15 is a flowchart illustrating another example of printing operations performed by the control unit.

Processes from S21 to S24 in FIG. 15 are the same as the processes from S1 to S4 in FIG. 7, and thus a description thereof is omitted. After the carriage 3 is moved to the start position for printing, the control unit 100 drives the carriage 3 and causes the recording heads 4 to discharge the ink droplets to the sheet 20 at S25 at the same time the conveyance belt 12 conveys the sheet 20 at S26. In other words, the carriage 3 and the sheet 20 are moved at the same time to form an image on the sheet 20. Thereafter, the process proceeds to S27 to determine whether or not printing is completed.

Because the relative amounts of movement dx and dy in the x and y directions respectively are calculated by directly reading the sheet 20 using the sensor 31 as described above, the relative amounts of movement dx and dy can be calculated even when the carriage 3 and the sheet 20 are moved at the same time. Accordingly, movement of the carriage 3 can be started even before the end of movement of the carriage 3 in the sub-scanning direction, improving productivity. Further, printing operations can be performed in a diagonal direction.

The following configuration can be achieved by providing the sensor 31 to the carriage 3. Specifically, for example, a reference position on the sheet 20 is read by the sensor 31, and the amount of movement of the carriage 3 and the amount of conveyance of the sheet 20 are controlled based on the reference position to form an image on the sheet 20. Accordingly, for example, even when printing operations are repeatedly performed on the same sheet or are performed on a sheet already having an image thereon, an image can be accurately printed at a desired print position on the sheet.

As described above, the sensor 31 can be used as a sensor that detects the leading edge of the sheet 20 and both sides of the sheet 20 in the main scanning direction, and automatically adjusts a timing to discharge the ink droplets from each of the recording heads 4 in the main scanning direction. Further, the sensor 31 can be used as a sensor that automatically adjusts a timing to discharge the ink droplets to prevent displacement of positions to discharge the ink droplets between successive reciprocal movements of the carriage 3 in the main scanning direction, and confirms discharge of the ink droplets from the nozzle arrays 4*n*. As a result, the sensor 31 can have many different functions, resulting in cost reduction.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2008-230029 filed on Sep. 8, 2008 in the Japan Patent Office, the entire contents of which are hereby incorporated herein by reference.

What is claimed is:

1. An image forming apparatus, comprising:

a carriage comprising image forming units, the carriage driven reciprocally back and forth in a main scanning direction;

a conveyance unit to convey a sheet of recording media to a position where the image forming units perform image formation;

a first detector provided to the carriage, the first detector comprising a light emitting part and a light receiving part to periodically detect a pattern from a surface of the sheet, and the detected pattern including light and dark portions on the surface of the sheet;

a calculation unit to calculate a relative amount of movement between the sheet and the image forming units by comparing patterns periodically detected by the first detector; and a control unit to control a timing to perform image formation by the image forming units and an amount of conveyance of the sheet conveyed by the conveyance unit based on a result calculated by the calculation unit, wherein the calculation unit calculates the relative amount of movement between the sheet and the image forming units by comparing a first pattern detected by the first detector including a particular arrangement of light and dark portions on the surface of the sheet and a second pattern detected by the first detector including the particular arrangement of light and dark portions on the surface of the sheet, the first pattern and the second pattern having been detected by the first detector at different points in time during movement of the carriage.

2. The image forming apparatus according to claim 1, wherein:

the first detector is positioned at a center of the carriage in the main scanning direction; and the image forming units are arranged on both sides of the first detector, respectively.

3. The image forming apparatus according to claim 1, further comprising a second detector.

4. The image forming apparatus according to claim 1, wherein the first detector comprises a focusing mechanism to focus on the sheet.

5. The image forming apparatus according to claim 1, wherein the first detector comprises a shutter to alternately expose and cover at least a surface of the light receiving part.

6. The image forming apparatus according to claim 1, wherein the first detector comprises a cleaning member.

7. The image forming apparatus according to claim 1, wherein the calculation unit calculates the relative amount of movement between the sheet and the image forming units by calculating an amount of movement of the particular arrangement of light and dark portions between the first pattern and the second pattern.

8. The image forming apparatus according to claim 1, wherein the calculation unit calculates a first relative amount of movement in the main scanning direction and a second relative amount of movement in a direction perpendicular to the main scanning direction.

9. An image forming apparatus comprising:

a carriage comprising image forming units, the carriage driven reciprocally back and forth in a main scanning direction;

a conveyance unit to convey a sheet of recording media to a position where the image forming units perform image formation;

a first detect provided to the carriage, the first detector comprising a light emitting part and a light receiving part to periodically detect a surface of the sheet;

a calculation unit to calculate a relative amount of movement between the sheet and the image forming units by comparing patterns periodically detected by the first detector; and a control unit to control a timing to perform image formation by the image forming units and an amount of conveyance of the sheet conveyed by the conveyance unit based on a result calculated by the calculation unit, wherein:

the calculation unit calculates a relative amount of movement between the conveyance unit and the image forming units by comparing patterns on a surface of the conveyance unit periodically detected by the first detector when the first detector does not face the sheet; and the control unit controls the timing to perform image formation by the image forming units and the amount of conveyance of the sheet conveyed by the conveyance unit based on the result calculated by the calculation unit.

10. The image forming apparatus according to claim 9, wherein:

the first detector is positioned at a center of the carriage in the main scanning direction; and the image forming units are arranged on both sides of the first detector, respectively.

11. The image forming apparatus according to claim 9, wherein the first detector comprises a focusing mechanism to focus on the sheet.

12. The image forming apparatus according to claim 9, wherein the first detector comprises a shutter to alternately expose and cover at least a surface of the light receiving part.

13. The image forming apparatus according to claim 9, wherein the first detector comprises a cleaning member.

14. An image forming apparatus, comprising:

a carriage comprising image forming units, the carriage driven reciprocally back and forth in a main scanning direction;

conveyance means for conveying a sheet of recording media to a position where the image forming units perform image formation;

detection means for periodically detecting a surface of the sheet, the detection means provided to the carriage and comprising a light emitting part and a light receiving part;

calculation means for calculating a relative amount of movement between the sheet and the image forming units by comparing patterns periodically detected by the detection means; and control means for controlling a timing to perform image formation by the image forming units and an amount of conveyance of the sheet conveyed by the conveyance means based on a result calculated by the calculation means, wherein the calculation means calculates a relative amount of movement between the conveyance means and the image forming units by comparing patterns on a surface of the conveyance means periodically detected by the detection means when the detection means does not face the sheet; and the control means controls the timing to perform image formation by the image forming units and the amount of conveyance of the sheet conveyed by the conveyance means based on the result calculated by the calculation means.

* * * * *